US006062073A

United States Patent [19]

Patton et al.

[11] Patent Number: 6,062,073

[45] Date of Patent: May 16, 2000

[54] IN SITU BOREHOLE SAMPLE ANALYZING PROBE AND VALVED CASING COUPLER THEREFOR

[75] Inventors: Franklin D. Patton, West Vancouver; Jan J. Divis, North Vancouver, both of Canada

[73] Assignee: Westbay Instruments, Inc., North Vancouver, Canada

[21] Appl. No.: 09/149,269

[22] Filed: Sep. 8, 1998

[51] Int. Cl.[7] ..... E21B 49/00

[52] U.S. Cl. ..... 73/152.28; 73/152.55; 166/264; 166/100

[58] Field of Search ..... 73/152.28, 152.23, 73/152.55, 152.18, 152.54; 166/100, 264

[56] References Cited

U.S. PATENT DOCUMENTS

| | | | |
|---|---|---|---|
| 3,323,360 | 6/1967 | Nutter | 73/152.23 |
| 3,323,361 | 6/1967 | Lebourg | 73/152.23 |
| 4,192,181 | 3/1980 | Patton et al. . | |
| 4,204,426 | 5/1980 | Patton et al. . | |
| 4,230,180 | 10/1980 | Patton et al. . | |
| 4,254,832 | 3/1981 | Patton et al. . | |
| 4,258,788 | 3/1981 | Patton et al. . | |
| 4,646,831 | 3/1987 | Marsh et al. | 166/264 |
| 4,779,681 | 10/1988 | York | 166/100 |
| 5,046,568 | 9/1991 | Cordry | 166/264 |
| 5,117,685 | 6/1992 | Goldschild | 73/152.55 |
| 5,460,224 | 10/1995 | Schalla et al. . | |
| 5,704,425 | 1/1998 | Divis et al. . | |
| 5,808,192 | 9/1998 | Schmidt | 73/152.55 |
| 5,831,156 | 11/1998 | Mullins | 73/152.18 |
| 6,000,470 | 12/1999 | Skinner et al. | 73/152.55 |

FOREIGN PATENT DOCUMENTS 2 036 137 6/1980 United Kingdom .

OTHER PUBLICATIONS

Hall, Stephen H., et al., Invention Report, Battelle Pacific Northwest Laboratories, Jun.1, 1992, 14 pages.

Weiss, R., Westbay MP System for Groundwater Monitoring, Technology Data Sheet, Aug. 1993, 2 pages.

"The Westbay MP System," product information, Westbay Instruments, Inc., 6 pages.

Westbay Instruments Inc., "Draft Operation Manual MP55 System Casing Trim Tool Model 030194," Feb. 20, 1995, 6 pages.

*Primary Examiner*—Hezron Williams
*Assistant Examiner*—Chad Soliz
*Attorney, Agent, or Firm*—Christensen O'Connor Johnson & Kindness PLLC

[57] ABSTRACT

An in situ underground sample analyzing apparatus for use in a multilevel borehole monitoring system is disclosed. A casing assembly comprising a plurality of elongate tubular casings (24) separated by measurement port couplers (26) is coaxially alignable in a borehole (20). The measurement port couplers (26) include an inlet measurement port (70*b*) for collecting fluid from an underground measurement zone (32) and an outlet measurement port (70*a*) for releasing fluid into the measurement zone (32). An in situ sample analyzing probe (124) is orientable in the casing assembly. The in situ sample analyzing probe (124) includes inlet and outlet probe ports (148*b* and 148*a*) alignable and mateable with the inlet and outlet measurement ports (70*b* and 70*a*). The inlet and outlet measurement ports (70*b* and 70*a*) typically include valves. When the operation of the in situ sample analyzing probe (124) causes the valves to open, the interior of the in situ sample analyzing probe (124) is then in fluid communication with the exterior of the measurement port coupler (26). A circulating system located in the in situ sample analyzing probe circulates fluid collected through the inlet probe port (148*b*) of the in situ sample analyzing probe (124) and the inlet measurement port (70*b*). The collected fluid is analyzed by chemical analyzing apparatus in communication with the circulating system. After in situ analysis, the circulating system releases at least a portion of the fluid through the outlet probe port (148*a*) and the outlet measurement port (70*a*) into the measurement zone (32). Alternatively, collected fluid can be stored for transportation to the surface for offsite analysis.

15 Claims, 11 Drawing Sheets

IN SITU BOREHOLE SAMPLE ANALYZING PROBE AND VALVED CASING COUPLER THEREFOR

FIELD OF THE INVENTION

This invention generally relates to underground sample analyzing probes, belowground casings and casing couplers, and in particular, to in situ borehole sample analyzing probes and valved couplers therefor.

BACKGROUND OF THE INVENTION

Land managers wishing to monitor the groundwater on their property have recognized the advantages of being able to divide a single borehole into a number of zones to allow monitoring of groundwater in each of those zones. If each zone is sealed from an adjacent zone, an accurate picture of the groundwater can be obtained at many levels without having to drill a number of boreholes that each have a different depth. A groundwater monitoring system capable of dividing a single borehole into a number of zones is disclosed in U.S. Pat. No. 4,204,426 (hereinafter the '426 patent). The monitoring system disclosed in the '426 patent is constructed of a plurality of casings that may be connected together in a casing assembly and inserted into a well or borehole. Some of the casings may be surrounded by a packer element made of a suitably elastic or stretchable material. The packer element may be inflated with fluid (gas or liquid) or other material to fill the annular void between the casing and the inner surface of the borehole. In this manner, a borehole can be selectively divided into a number of different zones by appropriate placement of the packers at different locations in the casing assembly. Inflating each packer isolates zones in the borehole between adjacent packers.

The casings in a casing assembly may be connected with a variety of different types of couplers or the casing segments may be joined together without couplings. One type of coupler that allows measurement of the quality of the liquid or gas in a particular zone is a coupler containing a valve measurement port (hereinafter the measurement port coupler). The valve can be opened from the inside of the coupler, allowing liquid or gas to be sampled from the zone surrounding the casing.

To perform sampling, a special measuring instrument or sample-taking probe is provided that can be moved up and down within the interior of the casing assembly. The probe may be lowered within the casing assembly on a cable to a known point near a measurement port coupler. As disclosed in the '426 patent, when the probe nears the location of the measurement port coupler, a location arm contained within the probe is extended. The location arm is caught by one of two helical shoulders that extend around the interior wall of the measurement port coupler. As the probe is lowered, the location arm slides down one of the helical shoulders, rotating the sample-taking probe as the probe is lowered. At the bottom of the helical shoulder, the location arm reaches a stop that halts the downward movement and circumferential rotation of the probe. When the location arm stops the probe, the probe is in an orientation such that a port on the probe is directly adjacent and aligned with the measurement port contained in the measurement port coupler.

When the probe is adjacent the measurement port, a shoe is extended from the side of the sample-taking probe to push the probe in a lateral direction within the casing. As the shoe is fully extended, the port in the probe is brought into contact with the measurement port in the measurement port coupler.

At the same time the probe is being pushed against the measurement port, the valve within the measurement port is being opened. The probe may therefore sample the gas or liquid contained in the zone located outside of the measurement port coupler. Depending upon the particular instruments contained within the probe, the probe may measure different characteristics of the exterior liquid or gas in the zone being monitored, such as the pressure, temperature, or chemical composition. Alternatively, the probe may also allow samples of gas or liquid from the zone immediately outside the casing to be stored and returned to the surface for analysis or pumped to the surface.

After the sampling is complete, the location arm and the shoe lever of the probe may be withdrawn, and the probe retrieved from the casing assembly. The valve in the measurement port closes when the shoe of the probe is withdrawn, thus separating the gas or liquid in the zone outside the measurement port from the gas or liquid inside. It will be appreciated that the probe may be raised and lowered to a variety of different zones within the casing assembly, in order to take samples at each of the zones. A land manager may select the type of probe and the number and location of the zones within a borehole to configure a groundwater monitoring system for a particular application. The expandability and flexibility of the disclosed groundwater monitoring system therefore offers a tremendous advantage over prior art methods requiring the drilling of multiple sampling wells.

While the measurement port coupler shown in the '426 patent allows multilevel sampling and monitoring within a borehole, it requires that the underground fluid samples be removed from a particular underground zone and transported within the probe to the surface where fluid analysis takes place. Offsite analysis suffers from many drawbacks. First, it is labor intensive. The fluid sample must be removed from the probe, transported elsewhere, and subsequently tested. Additionally, each step required by this offsite testing increases the probability of both quantitative and qualitative testing errors. Furthermore, removing the underground fluid sample from its native environment invariably compromises the accuracy of the offsite tests due to changes in, for example, pressure, pH, and other factors that cannot be controlled in sample transport and offsite testing. Finally, removal of a fluid sample from the contained fluid within a particular zone can compromise the physical characteristics of the remaining fluid within that zone such that the accuracy of future testing is affected. Fluid pressure can be compromised to the extent that minute rock fissures close, prohibiting or greatly increasing the difficulty of the gathering of future fluid samples.

A need thus exists for an in situ underground sample analyzing apparatus having a probe suitable for lowering into the ground to a specific zone level for extracting and analyzing fluid samples in situ. The present invention is directed to fulfilling this need. This need is particularly evident where the permeability or natural yield of fluid from the geologic formations is very low and/or where the natural environment is readily disturbed by conventional sampling methods.

SUMMARY OF THE INVENTION

In accordance with this invention, an in situ underground sample analyzing apparatus for use in a multilevel borehole monitoring system is provided. A tubular casing, coaxially alignable in a borehole, has a first opening for collecting fluid from the borehole and a second opening for releasing fluid back into the borehole. A compatible in situ sample analyzing probe is orientable in the tube casing. The in situ sample analyzing probe includes a first opening alignable with the first opening of the tubular casing, and a second opening alignable with the second opening of the tubular casing. A circulating system is located in the in situ sample analyzing probe for directing fluid collected through the first opening of the in situ sample analyzing probe and the first opening of the tubular casing to an analyzing apparatus. After in situ analysis, the circulating system releases at least a portion of the fluid through the second opening of the in situ sample analyzing probe and the second opening of the tubular casing into the borehole.

In accordance with other aspects of this invention, the in situ sample analyzing probe may also include a sample retaining portion that retains at least part of the collected fluid for non-in situ analysis when the in situ sample analyzing probe is returned to the surface. Preferably, the in situ sample analyzing probe also includes a supplementary fluid source in communication with the circulating system for releasing additional fluid from either the in situ sample analyzing probe or above ground into the borehole. The supplementary fluid is used to test the geologic formations in the borehole, to facilitate the circulation of fluid native to the borehole through the in situ sample analyzing probe, or to replace native geologic fluid removed by the in situ sample analyzing probe.

In accordance with further aspects of this invention, the in situ underground sample analyzing probe includes a guide portion having a location member mateable with a track on the interior surface of the tubular casing and an analyzing portion containing an in situ sample analyzing apparatus that is removably connected to the guide portion. Preferably, the first opening and the second opening of the in situ sample analyzing probe are located in the guide portion and are in fluid communication with the analyzing portion. Also, preferably, the guide portion includes an extendible shoe braceable against the interior surface of the tubular casing and positioned to laterally move the first opening and second opening of the in situ sample analyzing probe toward the first opening and the second opening of the tubular casing.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
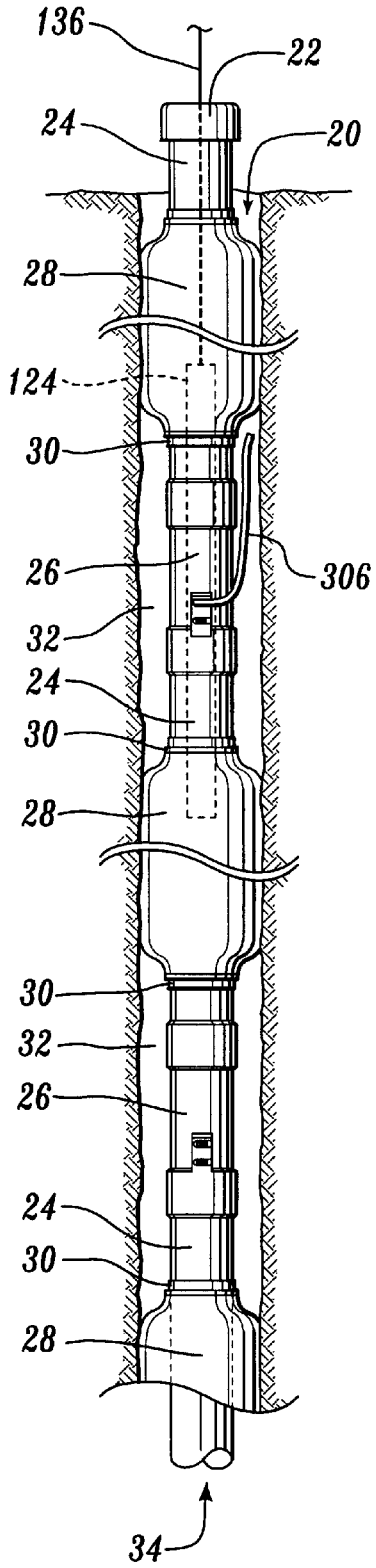
FIG. 1 is a diagram of a borehole in which geological casings are connected by measurement port couplers to form a casing assembly.

A cross section of a typical well or borehole 20 with which this invention may be used is shown in FIG. 1. Lowered into well or borehole 20 is a casing assembly 22. The casing assembly is constructed of a plurality of elongate casings 24 that are connected by measurement port couplers 26. Selected casings 24 are surrounded by a packer element 28. The packer elements are formed of a membrane or bag that is elastic or stretchable, such as natural rubber, synthetic rubber, or a plastic such as urethane. Urethane is preferred because it is readily moldable, and has high strength and abrasion characteristics. The packer element is clamped on opposite ends of elongate casing 24 by circular fasteners or clamps 30. The ends of each casing project beyond the ends of the packer element 28 to allow the casings to be joined together to form the casing assembly.

Using a method that is beyond the scope of this invention, the packer elements 28 are expanded to fill the annular space between the elongate casings 24 and the interior walls of the borehole 20. The expansion of the packer elements divides the borehole into a plurality of zones 32 that are isolated from each other. The number of zones that the borehole is divided into is determined by a user, who may selectively add elongate casings, packers, and couplers to configure a groundwater monitoring system for a given application.

The interior of the casings 24 and the measurement port couplers 26 form a continuous passageway 34 that extends the length of the casing assembly 22. An in situ sample analyzing probe 124 is lowered from the surface by a cable 136 to any desired level within the passageway 34. As will be described in further detail below, the measurement port couplers 26 each contain a pair of valved measurement ports that allow liquid or gas contained within the related zone 32 of the borehole to be sampled from inside of the casing assembly 22. The in situ sample analyzing probe 124 is lowered until it is adjacent to and mates with a desired measurement port coupler 26, at which time the measurement port valves are opened to allow the in situ sample analyzing probe 124 to measure pressure or to sample a characteristic of the gas or liquid within that zone. Further details about the general operation of a multilevel groundwater monitoring system of the type shown in FIG. 1 can be found in U.S. Pat. Nos. 4,192,181; 4,204,426; 4,230,180; 4,254,832; 4,258,788; and 5,704,425; all assigned to Westbay Instruments, Ltd., and expressly incorporated herein by reference.

Figure 2:
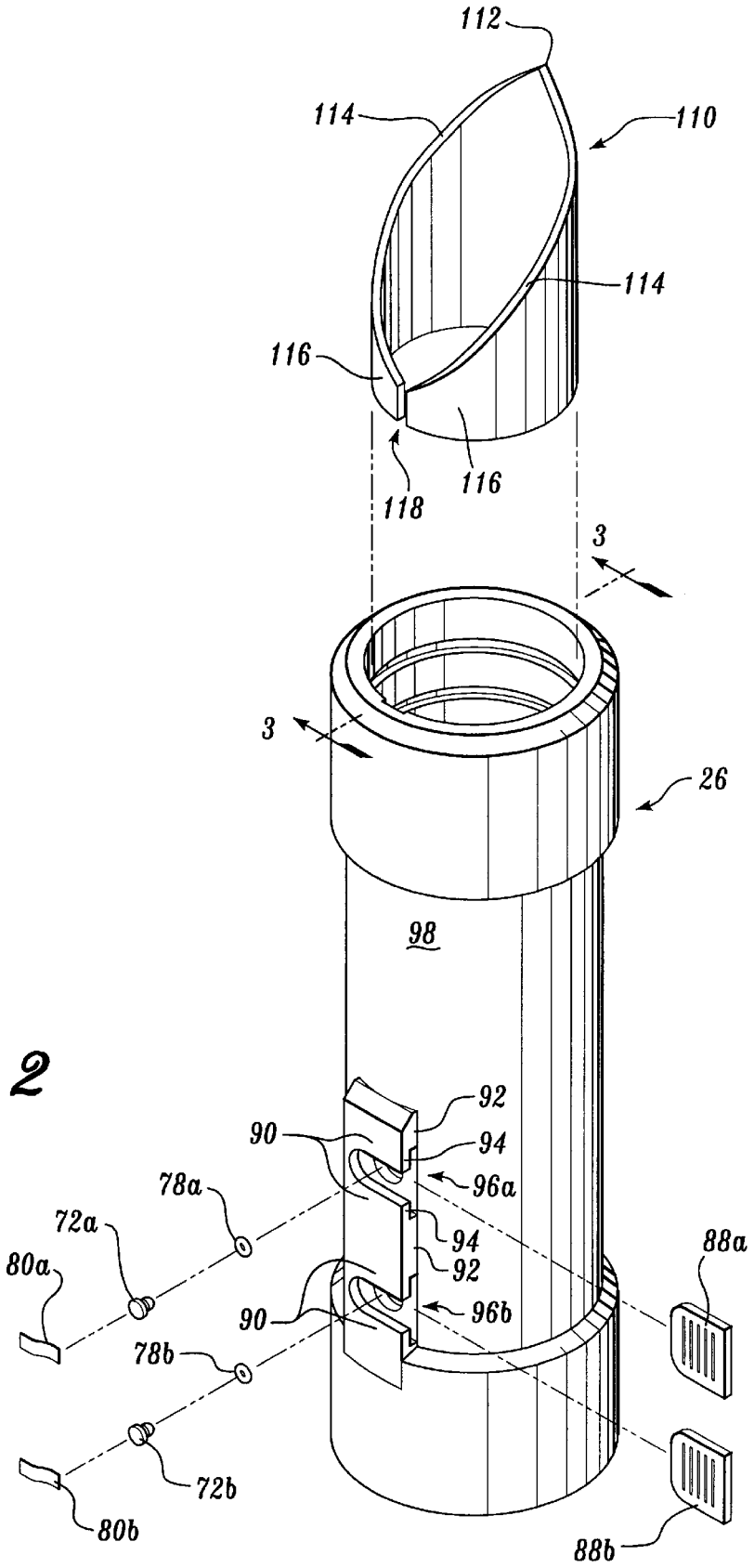
FIG. 2 is a side elevation view of a measurement port coupler usable with the present invention having two removable cover plates and a helical insert.
Figure 3:
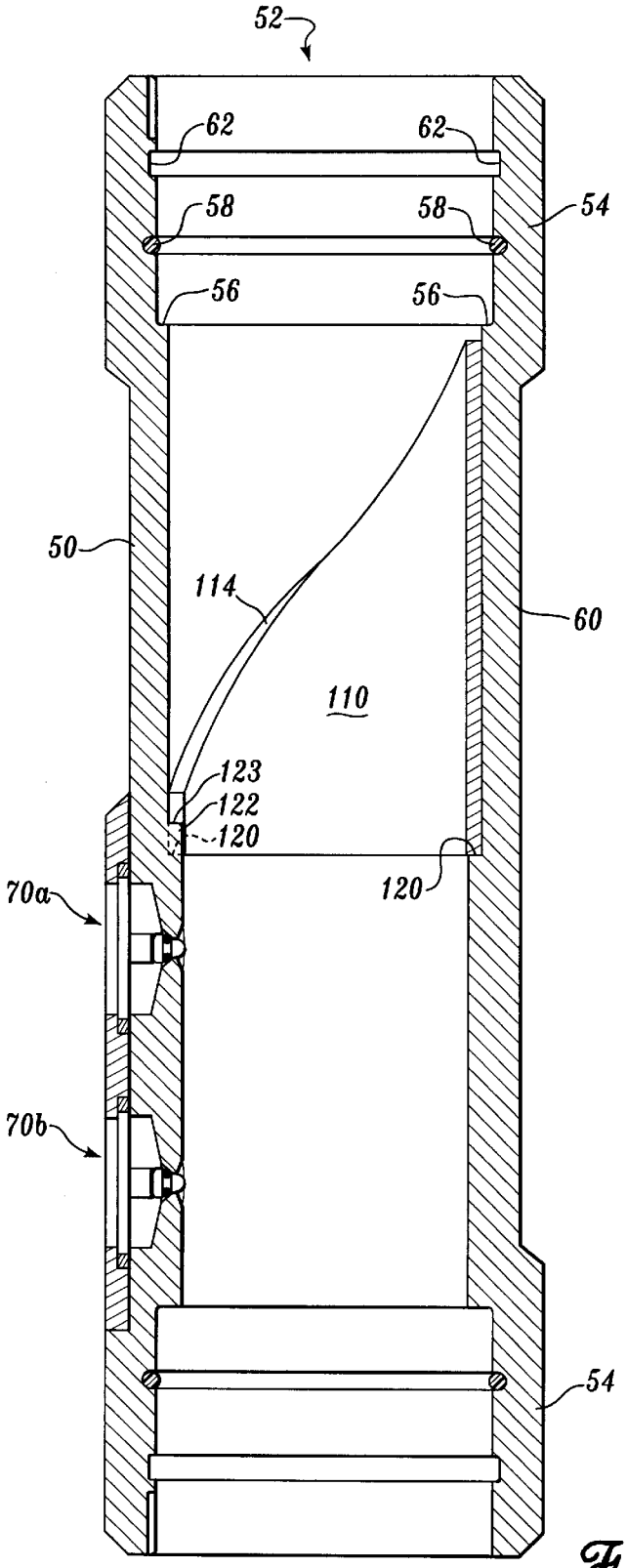
FIG. 3 is a longitudinal section view of the measurement port coupler taken along line 3—3 of FIG. 2.
Figure 4:
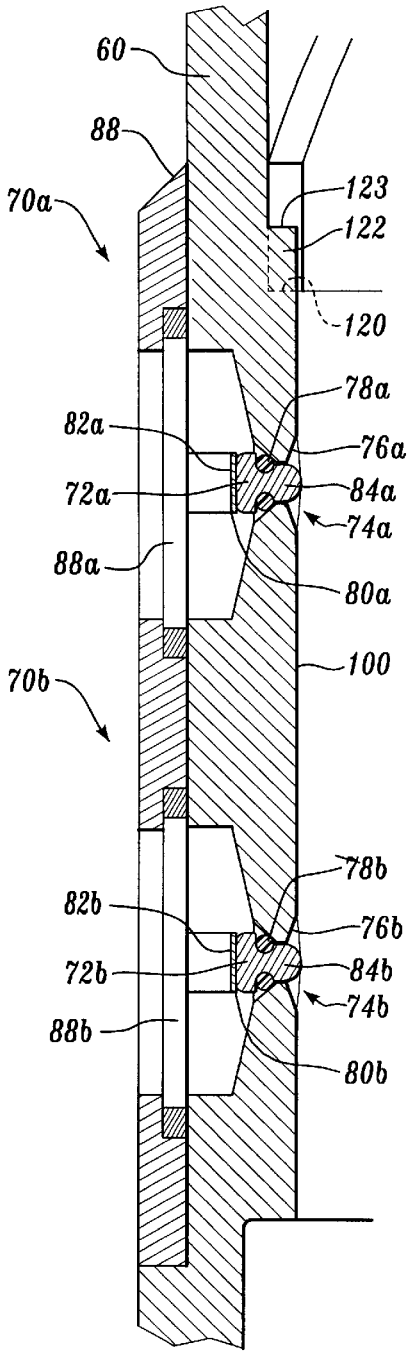
FIG. 4 is an expanded cross section view of a pair of measurement ports contained in the measurement port coupler.

A preferred embodiment of the measurement port coupler 26 is illustrated in FIGS. 2–4. As shown in FIGS. 2 and 3, the coupler 26 is generally tubular in shape with an external wall 50 surrounding and forming an inner passageway 52. The ends 54 of the coupler 26 are open and are typically of a larger diameter than the middle portion 60 of the coupler. The ends are sized to receive the ends of elongate casings 24. Casings 24 are inserted into the ends of the coupler 26 until they come into contact with stop 56 formed by a narrowing of passageway 52 to a smaller diameter. Suitable means for mating each of the couplers 26 to the elongate casings 24 are provided. Preferably, an O-ring gasket 58 is contained in the end portion 54 of each coupler 26 to provide a watertight seal between the exterior wall of the elongate casing 24 and the interior wall of the measurement port coupler 26. A flexible lock ring or wire (not shown) located in a groove 62 is used to lock the elongate casing 24 onto the measurement port coupler 26. Preferably, the cross section of the lock ring has a square or rectangular shape, though various other shapes will also serve the purpose.

When assembled, the elongate casings 24 and measurement port couplers 26 will be aligned along a common axis. The interior or bore of the elongate casings 24 has approximately the same diameter as the interior or bore of the couplers 26. A continuous passageway is therefore created along the length of the casing assembly 22.

The middle portion 60 of the measurement port coupler 26 contains measurement ports 70*a* and 70*b*. Preferably, the measurement ports 70*a* and 70*b* are aligned along a common vertical axis as shown best in cross section in FIG. 4. The measurement ports 70*a* and 70*b* each comprise valves 72*a* and 72*b*, respectively, that are seated within bores 74*a* and 74*b*, respectively, that pass through the wall 50 of the measurement port coupler 26. Valves 72*a* and 72*b* are each shaped like a cork bottle stopper, with larger rear portions 82*a* and 82*b*, respectively, facing the exterior of the measurement port coupler 26 and smaller and rounded stems 84*a* and 84*b*, respectively, facing the interior of the measurement port coupler 26. O-ring gaskets 78*a* and 78*b*, respectively, located around a middle portion of each of the valves 72*a* and 72*b* seal the valves 72*a* and 72*b* within bores 74*a* and 74*b*, respectively. The O-ring gaskets 78*a* and 78*b* provide airtight seals around the valves to ensure that fluids or other gases are not allowed into the passageway 52 from the exterior of the measurement port coupler 26 when the valves 72*a* and 72*b* are closed.

The valves 72*a* and 72*b* are normally biased closed by leaf springs 80*a* and 80*b*, respectively, and press against the rear portions 82*a* and 82*b*, respectively, of the valves 72*a* and 72*b*. The rear portions 82*a* and 82*b* of the valves 72*a* and 72*b*, respectively, are wider than the diameter of bores 74*a* and 74*b* to prevent the valves 72*a* and 72*b*, respectively, from being pushed into the interior of the measurement port coupler 26. Preferably, leaf springs 80*a* and 80*b* are held in place by two cover plates 88*a* and 88*b*. While leaf springs are preferred, it is to be understood that other types of springs may be used to bias valves 72*a* and 72*b* in a closed position, if desired.

Cover plates 88*a* and 88*b* are constructed of a wire mesh, slotted materials, or other type of filter material that fits over the exterior of the measurement ports 70*a* and 70*b*, respectively. As shown in FIG. 2, an exterior surface 98 of the measurement port coupler 26 is constructed with two sets of parallel circumferential retaining arms 90 that surround the measurement ports 70*a* and 70*b*, respectively. Each retaining arm 90 has a base 92 and an upper lip 94 that cooperate to form slots 96*a* and 96*b* shaped to receive the cover plates 88*a* and 88*b*, respectively. In FIG. 2, two adjacent arms 90, one forming the slot 96*a* and the other forming the slot 96*b*, are shown to be integrally formed. The cover plates 88*a* and 88*b* are slid within slots 96*a* and 96*b*, respectively, so that they are maintained in place by friction between the upper lip 94 of each retaining arm 90, the cover plates 88*a* and 88*b*, and the exterior surface 98 of the measurement port coupler 26. When affixed in place, the cover plates 88*a* and 88*b* entirely cover both of measurement ports 70*a* and 70*b* including the valves 72*a* and 72*b*, respectively. Any liquid or gas that passes from the exterior of the measurement port coupler 26 through the measurement ports 70*a* and 70*b* must therefore first pass through cover plates 88*a* and 88*b*. While slots are shown in cover plates 88*a* and 88*b*, it will be appreciated that holes or other apertures of different sizes and shapes may be selected depending on the necessary filtering in a particular application. Also, one or both of the cover plates 88*a* and 88*b* may be replaced with a flexible impervious plate attached to a tube 306 (see FIG, 1). In FIG. 1, only one tube 306 is shown. The tubes can be taped or otherwise attached to the exterior surface 98 of the coupler 26 or to the exterior surface of the adjacent casing 24, so that the openings of the tubes are away from each other. In this manner, the flow of fluids into and out of the two measurement ports 70*a* and 70*b* can be physically separated within a monitoring zone 32.

It will be appreciated that alternate methods may be used to secure the cover plates 88*a* and 88*b* to the exterior surface 98 of the measurement port coupler 26. For example, the cover plates 88*a* and 88*b* may be held in place by screws that pass through the cover plates 88*a* and 88*b* and into the body of the measurement port coupler 26. Alternately, clips or other fasteners may be fashioned to secure the edges of the cover plates 88*a* and 88*b*. Any means for securing the cover plates 88*a* and 88*b* to the measurement port coupler 26 must securely hold the cover plates 88*a* and 88*b*, yet allow removal of the cover plates 88*a* and 88*b* for access to the measurement ports 70*a* and 70*b*.

The cover plates 88*a* and 88*b* serve at least three purposes in the measurement port coupler 26. First, the cover plates 88*a* and 88*b* maintain the positions of the leaf springs 80*a* and 80*b* so that the springs 80*a* and 80*b* bias the valves 72*a* and 72*b*, respectively, in a closed position. Second, the cover plates 88*a* and 88*b* filter fluids that pass through the measurement ports 70*a* and 70*b*. The cover plates 88*a* and 88*b* ensure that large particles do not inadvertently pass through the measurement ports 70*a* and 70*b*, potentially damaging or blocking one or both of the valves 72*a* and 72*b* of the measurement ports 70*a* and 70*b* in an open or closed position. Because the cover plates 88*a* and 88*b* are removable and interchangeable, a user may select a desired screen or filter size that is suitable for the particular environment in which the multilevel sampling system is to be used. Finally, the cover plates 88*a* and 88*b* allow access to the valves 72*a* and 72*b*, and the measurement ports 70*a* and 70*b*. During manufacturing or after use in the field, the valves 72*a* and 72*b* must be tested to ensure that they correctly operate in the open and closed positions. If the valves 72*a* and 72*b* become defective, for example, by allowing water or gas to pass through one or both of the ports 70*a* and 70*b* while in the closed position, the cover plates 88*a* and 88*b* can be removed to allow the valves 72*a* and 72*b* and other components in the measurement ports 70*a* and 70*b* to be repaired. Thus, it is a simple matter to remove and replace valves 72*a* and 72*b*, O-ring gaskets 78*a* and 78*b*, or springs 80*a* and 80*b* if they are damaged during the manufacturing process or if they need to be replaced in a system that is to be reused.

Returning to FIG. 4, each valve 72*a* and 72*b* is seated in the wall of the measurement port coupler 26 at the apex of a conical depression 76*a* and 76*b*, respectively. The conical depressions 76*a* and 76*b* taper inward from an interior surface 100 of the measurement port coupler 26 to the start of the bores 74*a* and 74*b*. The valve stems 84*a* and 84*b* are sized so that the stems do not protrude beyond the interior surface 100 of the measurement port coupler 26. The valves 72*a* and 72*b*, therefore sit within the conical depressions 76*a* and 76*b*, respectively, at or below the level of the interior surface 100.

The conical depressions 76*a* and 76*b* serve several functions. First, the conical depressions 76*a* and 76*b* recess the valves 72*a* and 72*b*, below the level of the interior surface 100 so that an in situ sample analyzing probe 124 passing through the passageway 52 of the measurement port coupler 26 does not inadvertently open the valves 72*a* and 72*b*. In addition to preventing inadvertent opening, the valves 72*a* and 72*b* are also protected from abrasion or other damage as in situ sample analyzing probe 124 is raised and lowered through the passageway 34. Conical depressions 76*a* and 76*b* also provide protected surfaces against which the in situ sample analyzing probe 124 or other measurement tool seals when sampling fluids through the measurement ports 70*a* and 70*b*. Because the conical depressions 76*a* and 76*b* are recessed from the interior surface 100 of the measurement port coupler 26, the conical depressions 76*a* and 76*b* are protected from abrasions or other scarring that may occur as probes 124 pass through the passageway. The surfaces of the conical depressions 76*a* and 76*b* therefore remain relatively smooth, ensuring that precise and tight seals are made when sampling is being performed through the measurement ports 70*a* and 70*b*.

With respect to FIGS. 2 and 3, the middle portion 60 of the measurement port coupler 26 is constructed to allow insertion of a helical insert 110. The helical insert 110 is nearly cylindrical, with two symmetric halves that taper downwardly from an upper point 112 in a helical shoulder 114 before terminating at outer ends 116. A slot 118 separates the two halves of the insert between the outer ends 116.

The helical insert 110 may be fitted within the middle portion 60 by insertion into passageway 52 until the helical insert 110 contacts stop 120 formed by a narrowing of passageway 52 to a smaller diameter. A locating tab 122 protrudes from the interior surface of the measurement port coupler 26 to ensure proper orientation of the helical insert 110 in the measurement port coupler 26. When properly inserted, locating tab 122 fits within the slot 118 so that each helical shoulder 114 slopes downward toward the locating tab 122. As will be described in further detail below, the locating tab 122 is used to correctly orient the in situ sample analyzing probe 124 with respect to the measurement ports 70*a* and 70*b* and to expand the diameter of the helical insert 110 to provide an interference fit. The helical insert 110 is fixed in place in the measurement port coupler 26 by manufacturing the helical insert 110 to have a slightly larger diameter than the measurement port coupler 26. The halves of the helical insert 110 are flexed toward each other as the helical insert 110 is placed in the measurement port coupler 26. After insertion, the rebound tendency of the helical insert 110 secures the helical insert 110 against walls of the measurement port coupler 26. The helical insert 110 is further prevented from travel in the measurement port coupler 26 by stop 120, which prevents downward motion; locating tab 122, which prevents rotational motion and creates pressure against the halves that were flexed during insert; and a casing (not shown) fixed in the upper end 54 of the coupler 26, which prevents upward motion.

Forming the helical insert 110 as a separate piece greatly improves the manufacturability of the measurement port coupler 26. The measurement port coupler 26 may be made of a variety of different materials, including metals and plastics. Preferably, multilevel monitoring systems are constructed of polyvinyl chloride (PVC), stable plastics, stainless steel, or other corrosion-resistant metals so that contamination will not be introduced when the system is placed in a borehole. When plastic is used, it is very difficult to construct a PVC measurement port coupler 26 having an integral helical insert 110 without warping. Manufacturing the helical insert 110 separately, and then inserting the helical insert 110 into the interior of the measurement port coupler, allows the coupler to be constructed entirely of PVC. Securing the helical insert 110 in place without the use of glue further minimizes contamination that may be introduced into the borehole. The measurement ports 70*a* and 70*b* are provided to enable samples of liquids or gases to be taken and analyzed in situ from the borehole zone 32 outside of the measurement port coupler 26.

Figure 5:
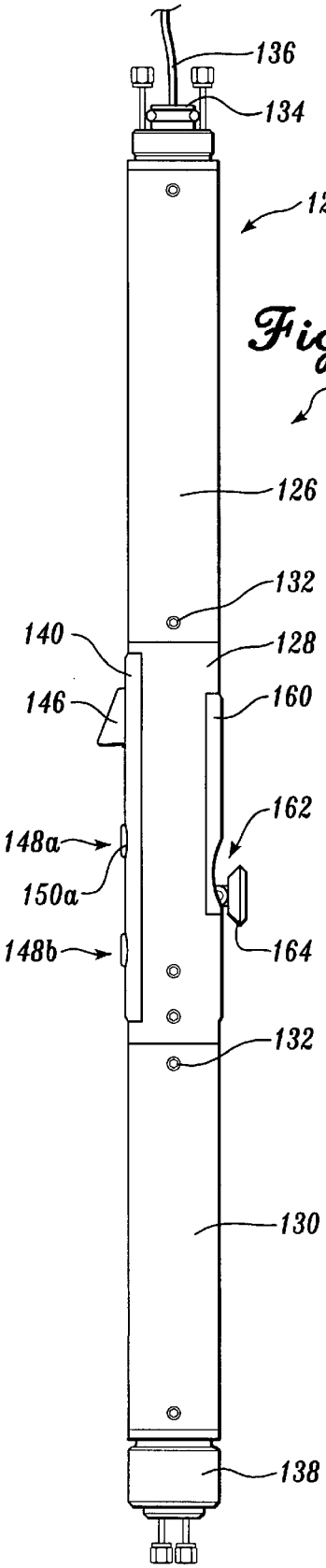
FIG. 5 is a diagrammatic elevation view of the guide portion of an in situ sample analyzing probe formed in accordance with the present invention.
Figure 6:
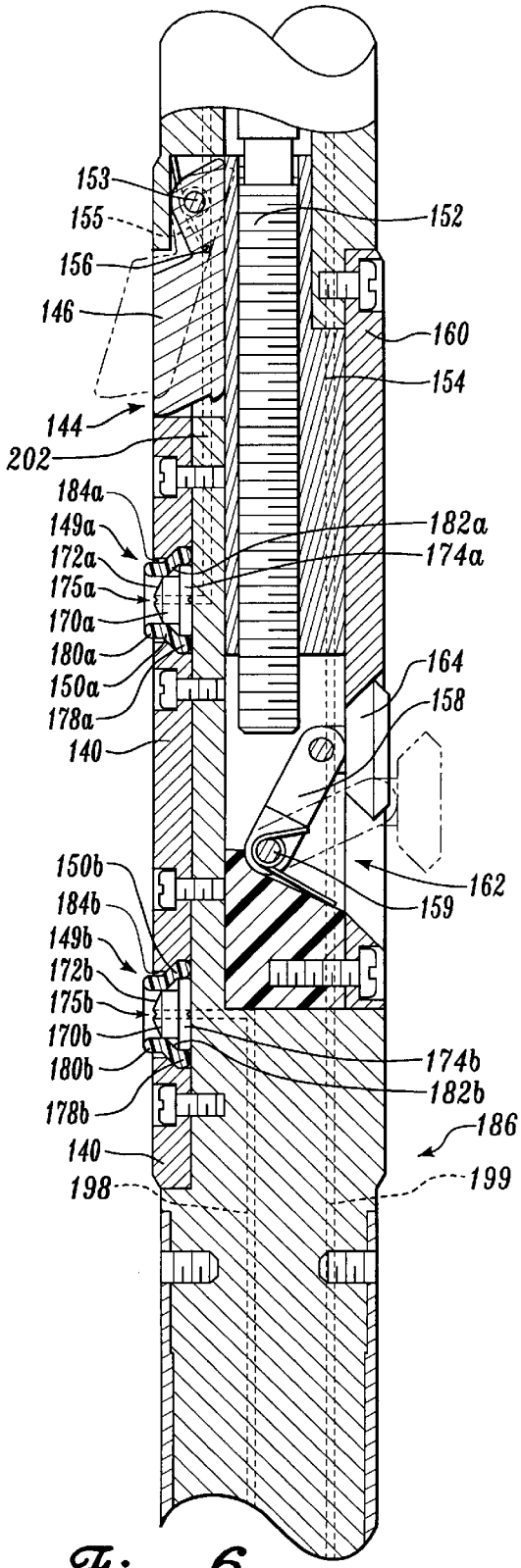
FIG. 6 is a longitudinal section view of the in situ sample analyzing probe shown in FIG. 5 showing the interface for mating with the measurement ports in the measurement port coupler.
Figure 8:
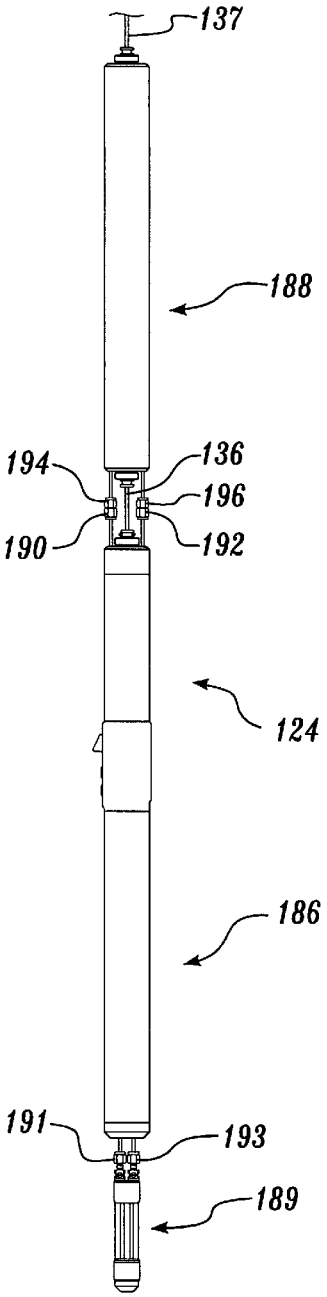
FIG. 8 is a pictorial view of the in situ analyzing portion, guide portion, and sample container portion connected to form the in situ analyzing probe of the present invention.

FIGS. 5, 6, and 8 illustrate an exemplary guide portion 186 of an in situ sample analyzing probe 124 formed in accordance with this invention that is suitable for lowering into casing assembly 22 to sample and analyze in situ gases and liquids in the borehole and to measure the fluid pressure when an in situ sample analyzing portion 188 is attached thereto. The guide portion 186 of an in situ sample analyzing probe 124 is generally in the form of an elongate cylinder having an upper casing 126, a middle casing 128, and a lower casing 130. The three casing sections are connected together by housing tube mounting screws 132 to form a single unit. Attached at the top of the guide portion 186 of an in situ sample analyzing probe 124 is a coupler 134 that allows the in situ sample analyzing probe 124 to be connected to an interconnecting cable 136. As shown in FIG. 8, cable 137 is used to raise and lower the in situ sample analyzing portion 188, and through the interconnecting cable 136 raise and lower the guide portion 186 of the probe 124 within the casing assembly. Interconnecting cable 136 and cable 137 also carry power and other electrical signals to allow information to be transmitted and received between a computer (not shown), located outside of the borehole, and the guide portion 186 and the pump and sensor modules in the analyzing portion 188 of an in situ sample analyzing probe 124 suspended in the borehole zone 32. An end cap 138 is disposed on the lower casing 130 to allow additional components to be attached to the guide portion 186 of the in situ sample analyzing probe 124 to configure the in situ sample analyzing probe 124 for a particular application.

The middle casing 128 of the guide portion 186 of in situ sample analyzing probe 124 contains an interface designed to mate with the ports 70*a* and 70*b* of the measurement port coupler 26. The interface includes a faceplate 140 laterally disposed on the side of middle casing 128. The faceplate 140 is semicylindrical in shape and matches the inside surface 100 of the measurement port coupler 26. The faceplate is slightly raised with respect to the outside surface of the cylindrical middle casing 128. The faceplate 140 includes a slot 144 that allows a locating arm 146 to extend from the in situ sample analyzing probe 124. In FIG. 5, the locating arm 146 is shown in an extended position where it protrudes from the middle casing 128 of the guide portion 186 of the in situ sample analyzing probe 124. The locating arm 146 is normally in a retracted position, as shown in FIG. 6, in which it is nearly flush with the surface of the guide portion 186 of the in situ sample analyzing probe 124. In the retracted position, the guide portion 186 of in situ sample analyzing probe 124 is free to be raised and lowered within the casing assembly 22.

When it is desired to stop the in situ sample analyzing probe 124 at one of the measurement port couplers 26 in order to take a measurement, the in situ sample analyzing probe 124 is lowered or raised until the guide portion 186 is positioned slightly above the known position of the measurement port coupler 26. The locating arm 146 is then extended, and the in situ sample analyzing probe 124 slowly lowered, allowing the guide portion 186 to begin to pass through the measurement port coupler 26. As the in situ sample analyzing probe 124 is lowered further, the locating arm 146 comes into contact with and then travels downward along the helical shoulder 114 until the locating arm 146 is caught within notch 118 at the bottom of the helical shoulder 114. The downward motion of the locating arm 146 on the helical shoulder 114 rotates the body of the in situ sample analyzing probe 124, bringing the guide portion 186 of the in situ sample analyzing probe 124 into a desired alignment position. When the locating arm 146 reaches the bottom of the notch 118, the guide portion 186 of the in situ sample analyzing probe 124 is brought to a halt by the upper surface 123 of locating tab 122. When the locating arm 146 is located on the locating tab 122, the guide portion 186 of the in situ sample analyzing probe 124 is oriented in the measurement port coupler 26 such that a pair of probe ports 148*a* and 148*b* are each aligned with one of the measurement ports 70*a* and 70*b*. The probe ports 148*a* and 148*b* are aligned in mating relationship to measurement ports 70*a* and 70*b*.

The probe ports 148*a* and 148*b* allow liquid or gas to enter or leave the guide portion 186 of the in situ sample analyzing probe 124. As shown in the cross section of FIG. 6, the probe ports 148*a* and 148*b* include apertures 149*a* and 149*b* formed in the common faceplate 140. Each probe port 148*a* and 148*b* also includes a plunger 170*a* and 170*b*, and an elastomeric face seal gasket 150*a* and 150*b*. The plungers 170*a* and 170*b* are generally cylindrical in shape and include outer protrusions 172*a* and 172*b*, that are typically conical. The shape of the conical protrusions correspond to the shape of the conical depressions 76*a* and 76*b* in the wall 50 of the measurement port coupler probe 26. The plungers 170*a* and 170*b* also include base portions 174*a* and 174*b*, having a larger diameter than the diameter of the body of plungers 170*a* and 170*b*. Bores 175*a* and 175*b*, formed in the plungers 170*a* and 170*b*, respectively, extend through the plungers 170*a* and 170*b*, into the interior of the guide portion 186 of the in situ sample analyzing probe 124. One of the bores 175*b* allows fluid to enter the guide portion 186 of in situ sample analyzing probe 124, and the other bore 175*a* allows fluid to exit the guide portion of the in situ sample analyzing probe 124. The fluid from the first bore 175*b* is channeled to the in situ fluid analyzer portion 188 of the in situ sample analyzing probe 124 as described below.

The face seal gaskets 150*a* and 150*b* are formed to surround the plungers 170*a* and 170*b*, and protrude beyond the outer surface of the faceplate 140. Each face seal gasket 150*a* and 150*b* has an outer portion 180*a* and 180*b*, having an inner diameter sized to surround the outer portion of the related plungers 170*a* and 170*b*; and inner portions 178*a* and 178*b*, having an inner diameter sized to surround the base portions 174*a* and 174*b*, of the plungers 170*a* and 170*b*. Each outer portion 180*a* and 180*b* has a rounded outer peripheral surface that is optimized for contact with one of the conical depressions 76*a* and 76*b*, respectively. It will be appreciated that the conical depressions 76*a* and 76*b* simplify the mating geometry of the face seal gaskets 150*a* and 150*b*. Rather than having to mate with a cylindrical surface, which requires a gasket that is curved along two axes, the face seal gaskets 150*a* and 150 must only be formed to mate with a conical surface along a single axis. This simplified gasket design provides a higher pressure seal than do the complex gasket geometries used in the prior art.

Each face seal gasket 150*a* and 150*b* is formed so that two expansion voids 182*a*, 182*b* and 184*a*, 184*b* exist around the face seal gasket. The first expansion voids 182*a* and 182*b* are located between the face seal gaskets 150*a* and 150*b*, and the plungers 170*a* and 170*b*. The second expansion voids 184*a* and 184*b* are located between the face seal gaskets 150*a* and 150*b*, and the faceplate 140. As described below, the expansion voids allow the face seal gaskets 150*a* and 150*b* to be fully compressed when the probe interfaces 148*a* and 148*b* of the guide portion 186 of the in situ sample analyzing probe 124 are brought into contact with the measurement ports 70*a* and 70*b*. Preferably, the face seal gaskets 150*a* and 150*b* are constructed of natural or synthetic rubber or some other compressible material that will create a tight seal.

The ports 148*a* and 148*b* are brought into sealing contact with the measurement ports 70*a* and 70*b*, respectively, by moving the in situ sample analyzing probe 124 laterally within the measurement port coupler 26. This movement is accomplished by a shoe 164 located in a shoe plate 160 positioned on the side of the middle casing 128 opposite the faceplate 140 and at approximately the midpoint between the ports 148*a* and 148*b*. The shoe plate 160 protrudes slightly from the outer cylindrical surface of middle casing 128. The shoe plate 160 is located in an aperture 162 that allows the shoe 164 to be withdrawn into the guide portion 186 of the in situ sample analyzing probe 124. In the extended position, the shoe 164 is brought into contact with the inner surface 100 of the measurement port coupler 26, halfway between the ports 148*a* and 148*b*, forcing the guide portion 186 of the in situ sample analyzing probe 124 laterally within the interior of the measurement port coupler 26. The thusly applied force brings the probe ports 148*a* and 148*b* into contact with the conical surfaces 76*a* and 76*b* of the measurement ports 70*a* and 70*b*.

The mechanism for extending the locating arm 146 and shoe 164 is shown in FIG. 6. A motor (not shown) in the upper probe casing 126 turns an actuator screw 152 in the middle casing 128. When turned in a forward direction, the actuator screw 152 causes a threaded actuator nut 154 to travel along the actuator screw 152 toward a shoe lever 158. The initial turns of the actuator screw 152 move the actuator nut 154 a sufficient distance downward in the body of in situ sample analyzing probe 124 to allow the locating arm 146 to pivot around a pivot pin 153. A coil spring 155 wound around the pivot pin 153 and attached to hole 156 in the locating arm 146 biases the locating arm 146 in the extended position. Additional turns of the actuator screw 152 move the actuator nut 154 further downward in the body of in situ sample analyzing probe 124 until the actuator screw 152 contacts a shoe lever 158. As the actuator nut 154 continues to advance, the shoe lever 158 pivots around a pivot pin 159, forcing the shoe 164 to swing outward from the body of the guide portion 186 of in situ sample analyzing probe 124. When the actuator nut 154 reaches a fully advanced position, the shoe 164 is extended, as shown in phantom in FIG. 6. The retraction of the actuator nut 154 reverses the extension process. When the actuator screw 152 is turned in a reverse direction, the actuator nut 154 is moved upward in the body of guide portion 186 of in situ sample analyzing probe 124. As the actuator nut 154 moves upward, the shoe 164 is retracted by a coil spring attached to the shoe lever 158 and pivot pin 159. Continued motion of the actuator nut 154 brings the actuator nut 154 into contact with the locating arm 146, pivoting the arm to a retracted position.

Figure 7A:
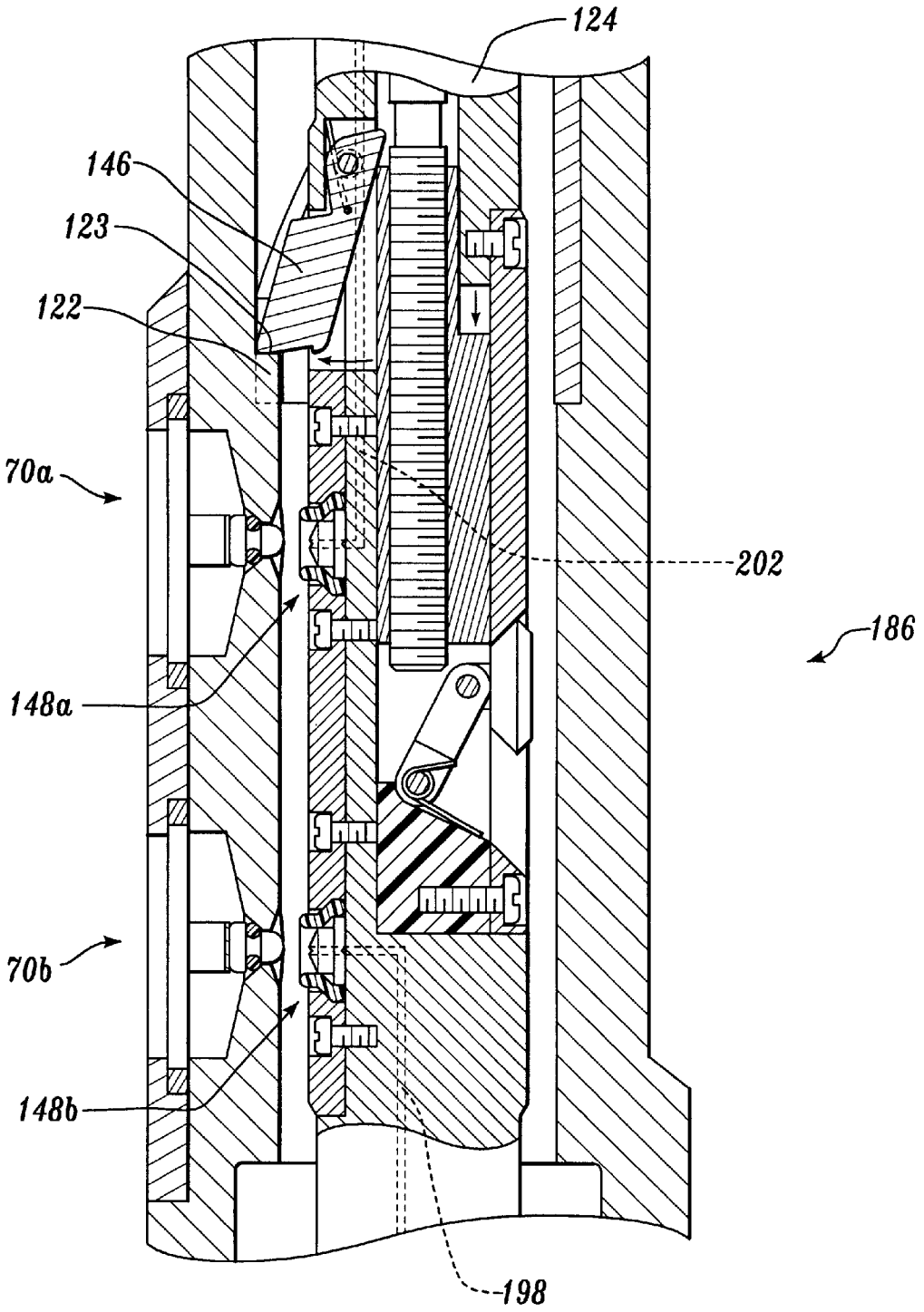
FIGS. 7A–7D are expanded cross section views of the in situ sample analyzing probe and the measurement port shown in FIG. 5 showing the sequence of events as the probe is pushed into contact with the measurement port to allow pressure measurements to be made or samples to be taken.

The interaction between the measurement port coupler 26 and the guide portion 186 of the in situ sample analyzing probe 124 may be better understood by the sequence shown in FIGS. 7A through 7D. FIG. 7A shows the in situ sample analyzing probe 124 lowered to the position where the probe interfaces 148*a* and 148*b* of the guide portion 186 are aligned with the ports 70*a* and 70*b*. As previously described, this position is achieved by extending the locating arm 146 and lowering the in situ sample analyzing probe 124 until the locating arm 146 comes into contact with the upper surface 123 of the locating tab 122.

Figure 7B:
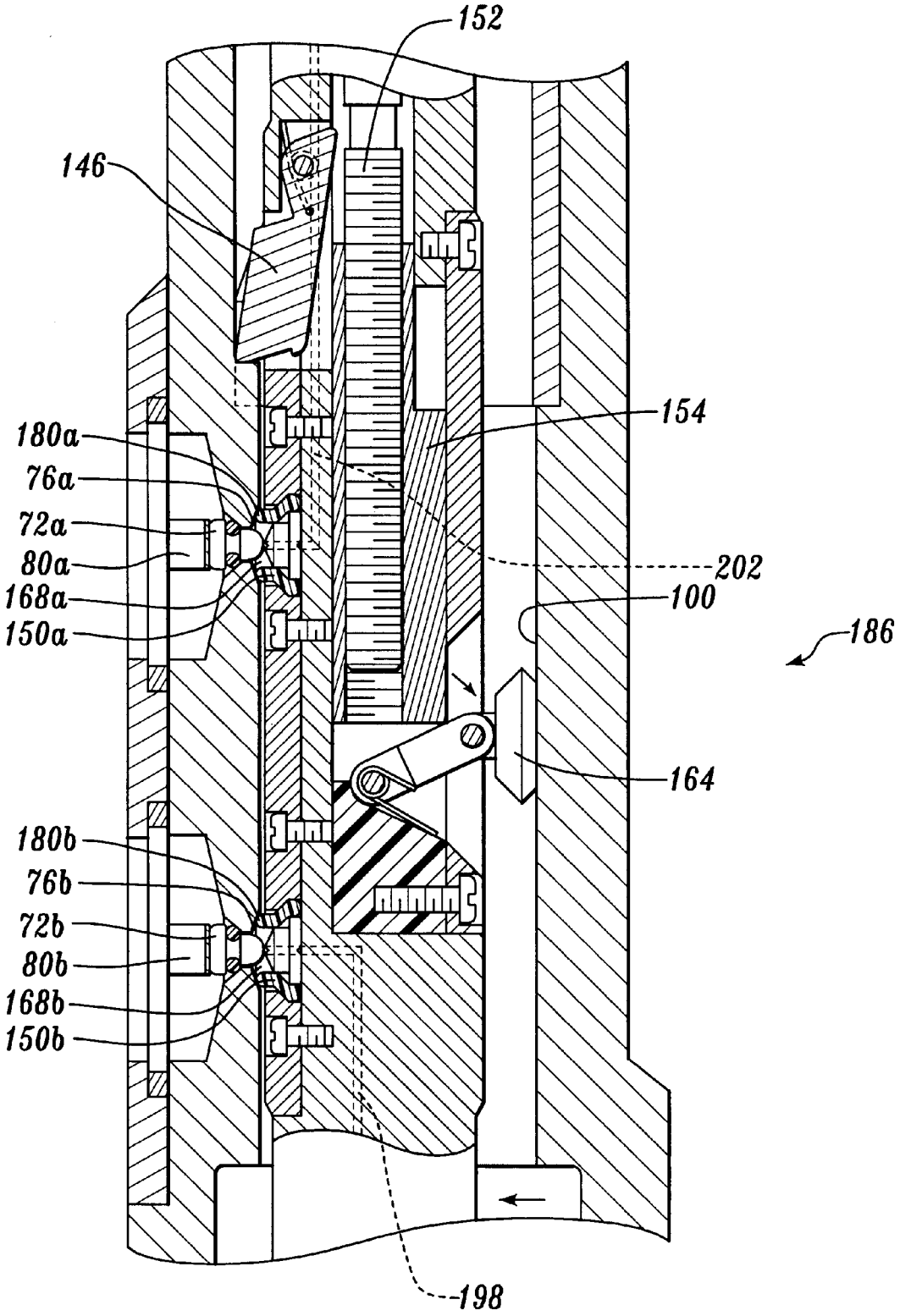

FIG. 7B shows the shoe 164 partially extended from the body of the guide portion 186 of the in situ sample analyzing probe 124. The shoe 164 is in contact with the interior surface 100 of the measurement port coupler 26. As the shoe 164 continues to extend from the body of the guide portion 186 of the in situ sample analyzing probe 124, the in situ sample analyzing probe 124 is pushed toward the measurement ports 70*a* and 70*b*. The shoe force is adequate to swing the locating arm 146 inward, overcoming the force of the coil spring 155, as the in situ sample analyzing probe 124 nears the wall 50 of the measurement port coupler 26. Prior to the measurement ports 70*a* and 70*b* being opened, the outer portions 180*a* and 180*b* of the face seal gaskets 150*a* and 150*b* contact the conical depressions 76*a* and 76*b* of the measurement ports 70*a* and 70*b*. This creates two seals between the guide portion 186 of the in situ sample analyzing probe 124 and the measurement ports 70*a* and 70*b*, respectively. At this point, volumes 168*a* and 168*b*, respectively, bounded by the face seal gaskets 150*a* and 150*b*, the conical depressions 76*a* and 76*b*, the valves 70*a* and 70*b*, and the plungers 170*a* and 170*b* are sealed from the exterior of the measurement port coupler 26 and the interior of the measurement port coupler 26. Any fluid that is contained within the measurement port coupler 26 is prevented by these seals from entering the in situ sample analyzing probe 124. These seals also prevent any fluid from outside of the measurement port coupler 26 from being released to the interior of the measurement port coupler 26 and changing the pressure that exists measured in the zone 32 located outside of the measurement ports 70*a* and 70*b*.

Figure 7C:
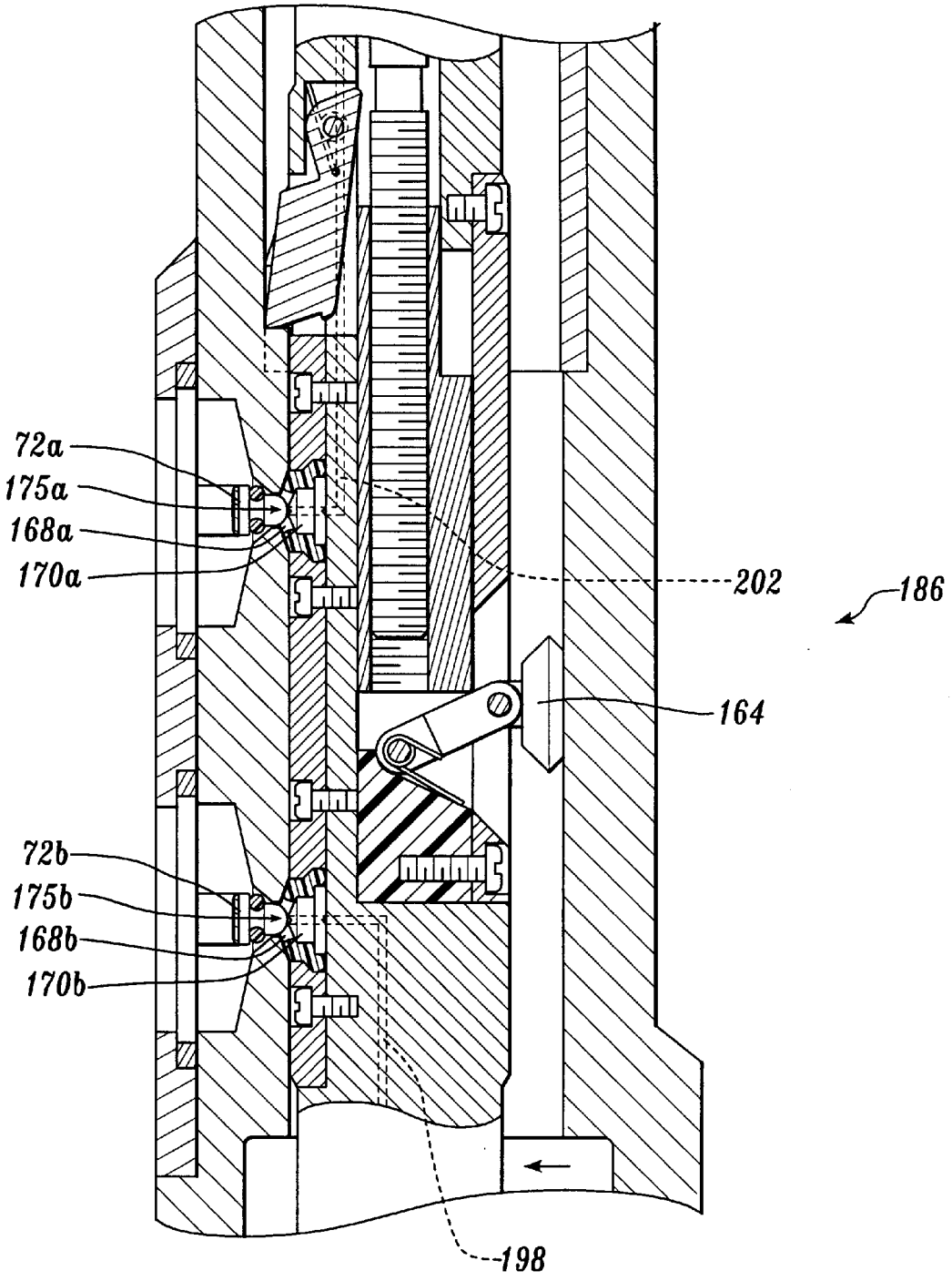

As shown in FIG. 7C, a continued extension of shoe 164 causes the plungers 170*a* and 170*b* to contact valves 72*a* and 72*b* and open the measurement ports 70*a* and 70*b*. As the plungers 170*a* and 170*b* open the measurement ports 70*a* and 70*b*, the sealed volumes 168*a* and 168*b* bounded by the face seal gaskets 150*a* and 150*b* and the conical depressions 76*a* and 76*b* of the measurement ports 70*a* and 70*b* are reduced. To keep the measured pressure nearly constant, the face seal gaskets 150*a* and 150*b* expand radially to fill the expansion voids 182*a* and 182*b* that surround the gaskets. The deformation of the face seal gaskets helps to compensate for any pressure increase due to the compression of the guide portion 186 of the in situ sample analyzing probe 124 into the measurement ports 70*a* and 70*b*. The compensation protects the often delicate in situ sample analyzing equipment from a spike of high pressure when the measurement port valves are being opened. Due to the compensation provided by the face seal gaskets 150*a* and 150*b* expanding into the expansion voids 182*a* and 182*b*, and 184*a* and 184*b*, the pressure remains relatively constant as the guide portion 186 of the in situ sample analyzing probe 124 is biased against the measurement ports 70*a* and 70*b*.

When the plungers 170*a* and 170*b* contact and open the port valves 72*a* and 72*b*, respectively, fluid passageways extend from outside the measurement port coupler 26 through the measurement ports 70*a* and 70*b* and through bores 175*a* and 175*b* into the guide portion 186 of the in situ sample analyzing probe 124. The seals between the face seal gaskets 150*a* and 150*b* and the conical depressions 76*a* and 76*b*, respectively, prevent fluid from inside the measurement port coupler 26 from contaminating sampled material passing through these passageways. Because the conical depressions 76*a* and 76*b* are protected from scratching, pitting, or other wear caused by movement of the in situ sample analyzing probe 124 within the measurement port coupler 26, these seals remain reliable for the life of the multilevel monitoring system.

When in situ analyzing, sampling or measurement is complete, the guide portion 186 of the in situ sample analyzing probe 124 may be released and moved to a different measurement port coupler 26. Release is accomplished by slowly retracting the shoe 164 into the guide portion 186 of the in situ sample analyzing probe 124. As this occurs, the in situ sample analyzing probe 124 moves through the intermediate position as shown in FIG. 7B and described above. As the guide portion 186 of in situ sample analyzing probe 124 moves away from the measurement port 26, the pressure on the valves 72*a* and 72*b* is removed, allowing the springs 80*a* and 80*b* to return the valves 72*a* and 72*b* to their closed position. Closing the measurement ports 70*a* and 70*b* prevents fluid from outside of the measurement port coupler 26 from flowing into the interior of the measurement port coupler 26. At the same time, the seal between the guide portion 186 of the in situ sample analyzing probe 124 and the measurement ports 70*a* and 70*b* is maintained by the face seal gaskets 150*a* and 150*b*, preventing fluid from flowing into the interior of the measurement port coupler 26.

Figure 7D:
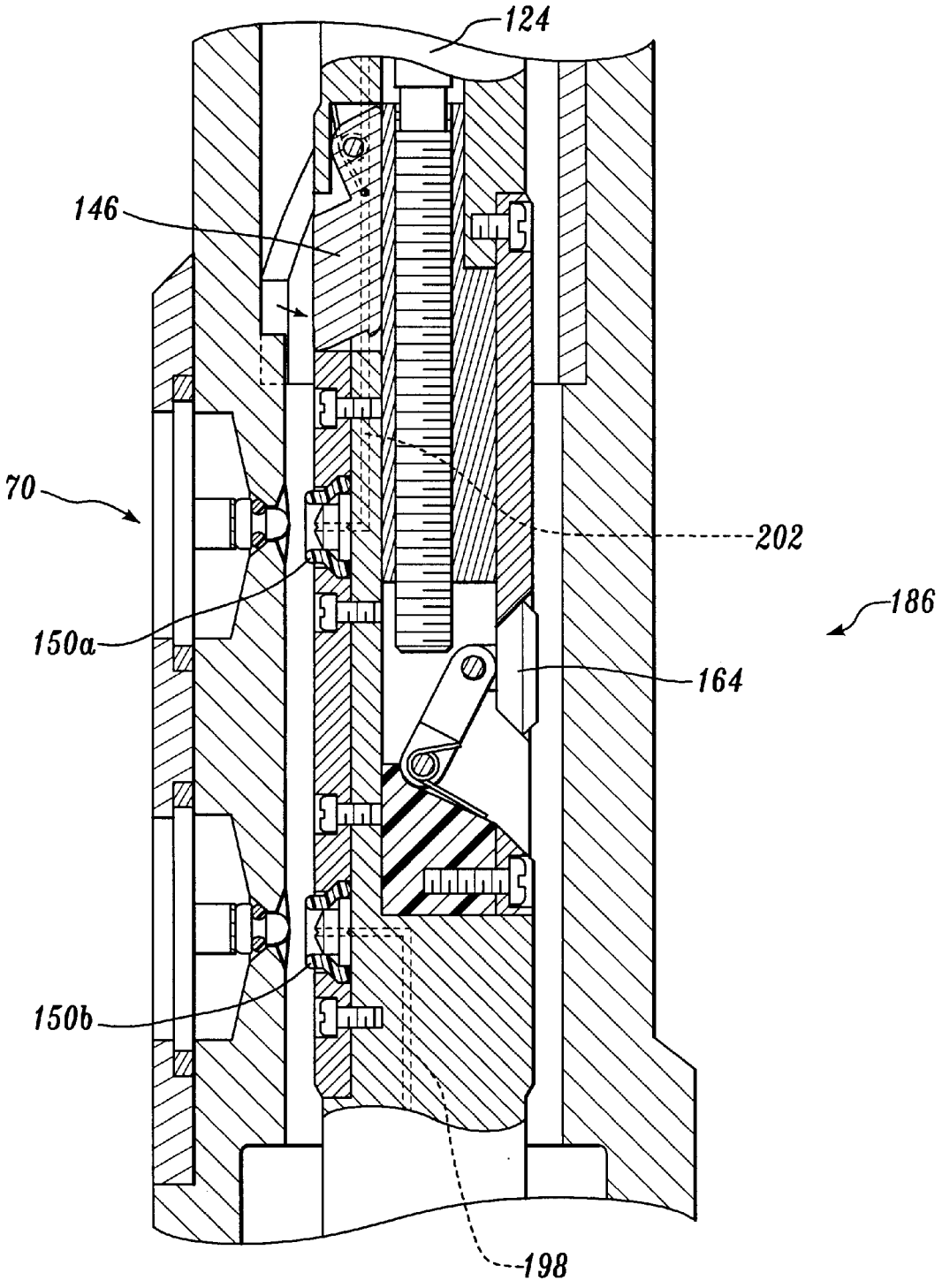

When the shoe 164 and actuator arm 146 are fully retracted, as shown in FIG. 7D, the face seal gaskets 150*a* and 150*b* are free to move away from the measurement ports 70*a* and 70*b*. Thus, the in situ sample analyzing probe 124 is ready to be raised or lowered to a different measurement port coupler 26. As noted above, because the measurement port valves 72*a* and 72*b* are recessed, movement of the in situ sample analyzing probe 124 within the casing assembly does not inadvertently cause the measurement ports 70*a* and 70*b* to open.

As shown in FIG. 8, in addition to the guide portion 186 shown in FIGS. 5–7, an in situ sample analyzing probe 124 also includes an analyzing portion 188 and, if desired, a storage portion 189.

Figure 9:
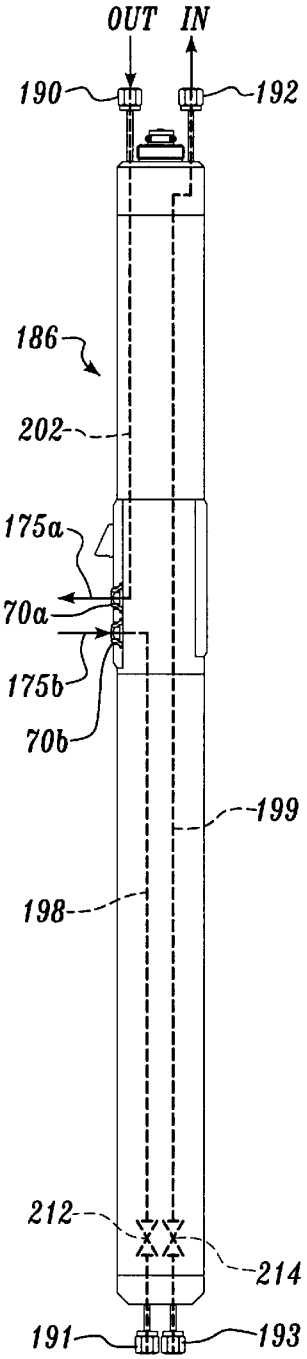
FIG. 9 is a diagrammatic view of the guide portion of the in situ sample analyzing probe shown in FIG. 5.
Figure 10:
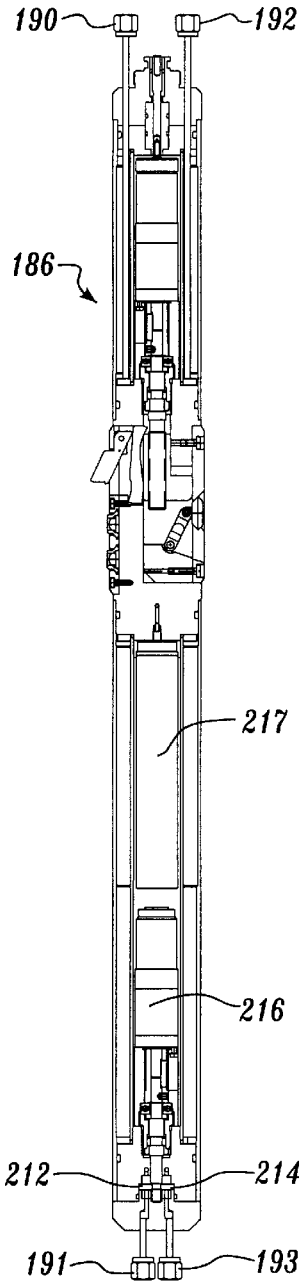
FIG. 10 is a pictorial view of the guide portion of the in situ sample analyzing probe shown in FIG. 5.
Figure 11:
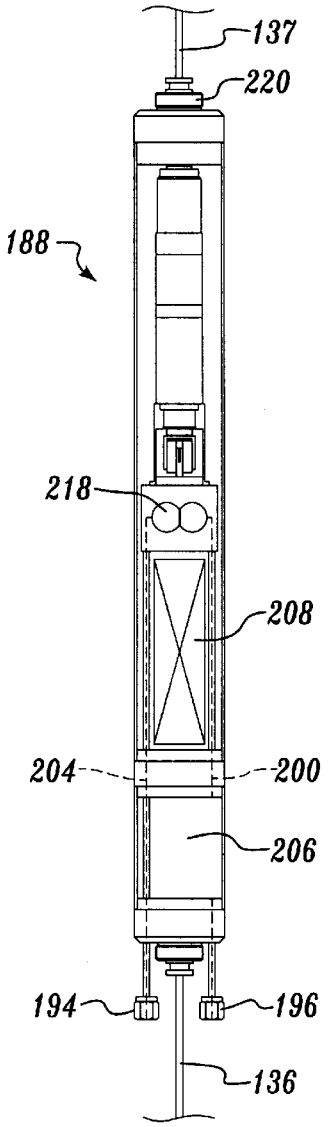
FIG. 11 is a pictorial view of the in situ analyzing portion of an in situ sample analyzing probe formed in accordance with the present invention.
Figure 12:
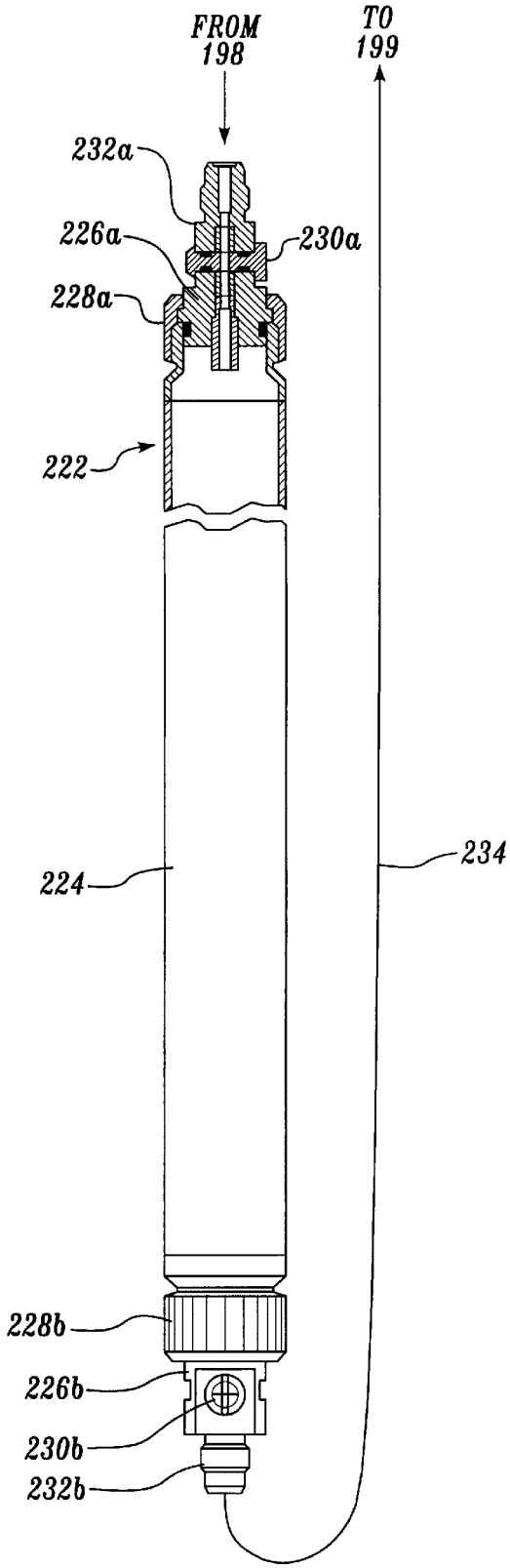
FIG. 12 is a pictorial view of a first embodiment of the sample container of the in situ sample analyzing probe of the present invention.

Referring to FIGS. 9, 10, and 11, the exemplary analyzing portion 188 of the in situ sample analyzing probe 124 and its connection to the guide portion 186 will now be described. The guide portion 186 shown in FIGS. 5–7 and described above is removably attached to the analyzing portion 188 shown in FIG. 11 by connecting threaded connectors 190 and 192 located on the top of the guide portion 186 with threaded connectors 194 and 196, located on the bottom of the analyzing portion 188, as shown in FIG. 8. The threaded connection of the guide portion 186 and the analyzing portion 188 allows different guide portions 186 to be used with different analyzing portions. Threaded connectors 191 and 193 located on the bottom of the guide portion 186 of the in situ sample analyzing probe 124 are used to connect the guide portion to the storage portion 189 that includes a storage tube or canister. Alternatively, if a storage portion 189 is not included, the bottom threaded connectors 191 and 193 are connected together by a jumper connection (not shown).

Referring to FIGS. 9 and 10, one of the probe ports 148*a* and 148*b* of the guide portion 186 functions as an inlet port and the other functions as an outlet port. The bore 175*b* of the inlet probe port 148*b* is connected to one end of an inlet line 198, and the bore 175*a* of the outlet probe port 148*a* is connected to one end of an outlet line 202. The other end of the inlet line 198 is connected through an inlet line valve 212 to one of the connectors 191 located at the bottom of the guide portion 186 of the in situ sample analyzing probe 124. The other end of the outlet line 202 is connected to one of the connectors 190 located at the top of the guide portion 186. A cross-connector line 199 connects the other connector 192 located at the top of the guide portion 186 to the other connector 193 located at the bottom. An output line valve 214 is located in the cross-connector line 199.

As will be appreciated from the foregoing description, fluid extracted from an underground zone 32 passes through the bore 175*b* of the inlet probe port 148*b* to the fluid input line 198 of the guide portion 186. If the inlet line valve 212 is open, the fluid either enters the storage portion 189 (if included) or is directed to the connector 193 and thereby to the cross-connector line 199 (if a jumper is used). Fluid leaving the storage portion or jumpered to the cross-connector line 199 passes through the outlet line valve 214 (if open) and is applied to the sample analyzing portion 188. Fluid leaving the sample analyzing portion 188 enters the outlet line 202 and exits the in situ sample analyzing probe 124 via the bore 175*a* of the outlet probe port 148*a*.

Prior to undergoing in situ analysis, fluid from underground zone 32 may be stored in a storage tube or canister that forms a part of the storage portion, as described in further detail below. The storage tube or canister forms an interface between the fluid input line 198 of guide portion 186 and the cross-connector line 199.

The input line valve 212 and the output line valve 214 are both independently actuatable by a valve motor 216 housed in the guide portion 186 of the in situ sample analyzing probe 124. As a result, the storage tube or canister that forms part of the storage portion 189 can be entirely sealed from fluid input line 198 or from the cross-connector line 199. If both valves are open, fluid passes to the analyzing portion 188 where it is analyzed. If the input line valve 212 is open and the output line valve 214 is closed, a fluid sample from a zone 32 can be stored in the storage canister for transportation to the surface for non-in situ analysis offsite. After the sample is taken, the input line valve 212 is, of course, closed to assist in preventing the fluid from leaking out of the storage canister during removal from the borehole. Located above the valve motor 216 is guide portion control module 217 that provides data transfer, telemetry, and/or guidance control commands between guide portion 186 and a surface-located operator.

Referring to FIG. 11, the analyzing portion 188 of the in situ analyzing probe 124 includes fluid sensors 206. The input of the fluid sensors 206 is connected to the connector 196. As shown in FIG. 8, connector 196 connects the analyzing portion 188 to connector 192 of the cross-connector line 199 of the guide portion 186. The outlet of the fluid sensors 206 is connected via a line 200 to the inlet of a recirculating pump 218. The outlet of the recirculating pump 218 is connected via a line 204 to the connector 194. Connector 194 connects the analyzing portion 188 to connector 190 of the outlet line 202 of the guide portion 186. The fluid sensors 206 are controlled by a fluid sensor electronic module 208, which provides data to a surface-located operation via a cable 137 connected to connector 220, or stores data for later readout.

The fluid sensors 206 analyze in situ the physical and/or chemical properties of fluid extracted from an underground zone 32. The fluid sensors 206 may measure, for example, the pressure, temperature, pH, eH, DO, and conductivity of the fluid in the underground zone 32. As will be readily apparent to those skilled in the art, other physical and/or chemical parameters and properties of fluid from underground zone 32 also can be measured, depending on the nature of the specific fluid sensors included in the fluid sensors 206 and the corresponding electronic components and circuits included in the fluid sensor electronic module 208.

The recirculating pump 218 supplies the fluid pressure required to circulate fluid from or to underground zone 32 through the in situ sample analyzing probe 124. Optionally, recirculating pump 218 can also pump supplemental fluid stored in one of the portions of the in situ sample analyzing probe 124 or fed from the surface, to the underground zone 32 from which fluid is being removed in order to maintain the fluid pressure in the underground zone 32 at a level required to maintain the zone as a viable sampling stratum.

The connector 134 (see FIG. 5) attached to the top of guide portion 186 is dimensionally the same as connector 220 attached to the top of the in situ sample analyzing portion 188 illustrated in FIG. 11. This similarity allows either module 186 or 188 to be connected independently to the surface.

FIGS. 12, 13, 14A, 14B, 14C, and 15 show three storage portions suitable for use in the in situ sample analyzing probe 124. The storage portion 222 shown in FIG. 12 includes a storage canister 224, which is preferably a hollow tubular member having two ends. Each of the ends of the storage canister 224 is closed by an endpiece 226*a* and 226*b*. The endpieces 226*a* and 226*b* are surrounded by threaded collars 228*a* and 228*b*, which secure the endpieces 226*a* and 226*b* onto the ends of the storage canister 224. Each of the endpieces 226*a* and 226*b* includes a valve 230*a* and 230*b*. The valves 230*a* and 230*b* control the storage and removal of fluids stored in storage canister 224 for non-in situ analysis offsite after the in situ sample analyzing probe 124 has been removed from the casing assembly 22 and borehole 20.

More specifically, prior to insertion in a borehole 20, the valves 230*a* and 230*b* are opened, after the storage portion 222 is connected to the guide portion 186 in the manner described below. After the in situ sample analyzing probe 124 is removed from a borehole, the valves 230*a* and 230*b* are closed, trapping the sample in the storage canister 224. The storage portion 222 is then removed from the guide portion 186 and transported to a sample analysis laboratory. After the storage portion is connected to suitable analysis equipment, the valves 230*a* and 230*b* are opened, allowing the sample to be withdrawn from the storage canister 224.

Connectors 232*a* and 232*b* are located on the external ends of the endpieces 226*a* and 226*b*. One of the connectors 232*a* attaches the storage canister 224 to the inlet line 198 of the guide portion 186. The other connector 232*b* connects the storage canister 224 to one end of a return line 234. The other end of the return line 234 is connected to the cross-connector line 199 of the guide portion 186.

To collect a fluid sample for non-in situ offsite analysis, after the in situ sampling probe has been inserted into a borehole and aligned with a measurement port coupler 26 in the manner previously described, the valve motor 216 of the guide portion 186 is actuated to open input line valve 212 and output line valve 214. The fluid sample from a zone 32 passes through input line 198 of the guide portion 186 and into the storage canister 224. After the desired amount of fluid enters the storage canister 224, the valve motor 216 is actuated to close input line valve 212 and output line valve 214. Thereafter, as noted above, the in situ sample analyzing probe 124 is removed from the borehole and storage portion 222 is disconnected from guide portion 186 and transferred to a laboratory for non-in situ analysis offsite. An alternative to opening both the input and the output line valves 212 and 214 is to evacuate the storage canister prior to use. In this case, only the input line valve needs to be opened in order for a sample to enter the storage canister 224.

Obviously, both in situ analysis and sample storage can be simultaneously performed. In this case, both the input line valve 212 and the output line valve 214 are opened by the valve motor 216 located in the guide portion 186. Fluid from a zone 32 passes through the input line 198 into the storage canister 224 and, then, out of the storage canister 224 into the return line 234. The fluid then passes through the cross-connector line 199 and enters the analyzing portion 188 for in situ analysis as described above. After sufficient fluid has been analyzed, the input and output line valves 212 and 214 are closed by the valve motor 216, resulting in fluid from zone 32 being stored in the storage canister 224.

FIGS. 13, 14A, 14B, and 14C illustrate a second storage portion 238 suitable for use in the in situ sample analyzing probe 124. This storage portion 238 includes a plurality of spaced-apart storage tubes, preferably four, 240*a*, 240*b*, 240*c*, and 240*d*. The storage tubes 240*a*, 240*b*, 240*c*, and 240*d* lie parallel to one another and define the four edges of a phantom box. The storage tubes 240*a*, 240*b*, 240*c*, and 240*d* are, preferably, formed of an inert, malleable metal such as, for example, copper.

A tie rod 242 that lies parallel to the storage tubes is located in the center of the phantom box defined by the four storage tubes 240*a*, 240*b*, 240*c*, and 240*d*. The tie rod 242 links a top manifold 244 to a bottom manifold 246. More specifically, the upper end of tie rod 242 is threaded into a central opening 243 in the top manifold 244. The bottom end of tie rod 242 slidably passes through a central opening 245 in the bottom manifold 246.

Figure 13:
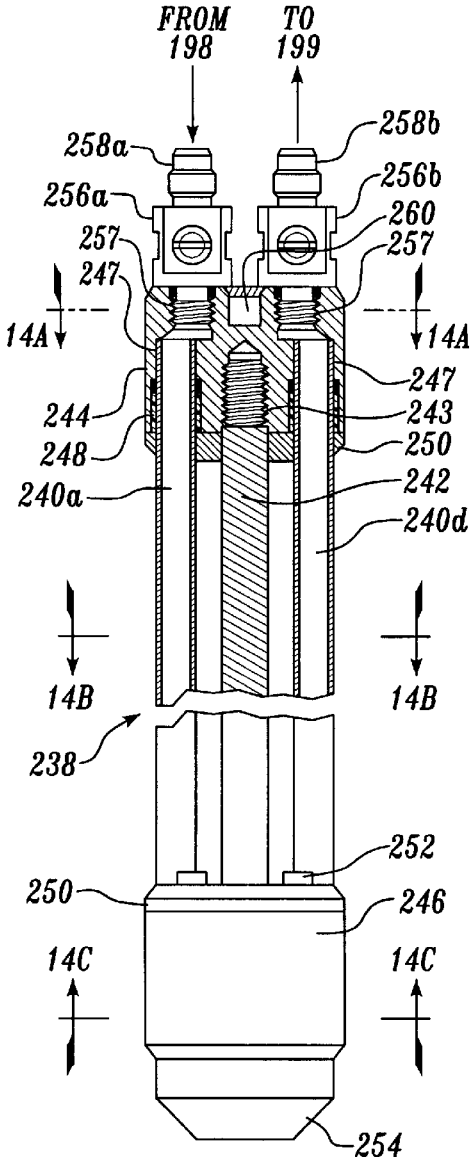
FIG. 13 is a pictorial view of a second embodiment of the sample container of the in situ sample analyzing probe of the present invention.

The upper ends of the storage tubes 240*a*, 240*b*, 240*c*, and 240*d* fit in openings 247 in the top manifold 244 that are outwardly spaced from the central opening 243 in the top manifold 244. The bottom ends of the storage tubes 240*a*, 240*b*, 240*c*, and 240*d* fit in openings in the bottom manifold 246 that are outwardly spaced from the central opening 245 in bottom manifold 246 through which the tie rod 242 slidably passes. Bushings 248 surround each end of each of the storage tubes 240*a*, 240*b*, 240*c*, and 240*d*. The bushings 248 are preferably comprised of tetrafluoroethylene (TEFLON®) and facilitate a snug fit of the storage tubes 240*a*, 240*b*, 240*c*, and 240*d* into the top and bottom manifolds 244 and 246 without preventing removal. Preferably, a slight space exists between the bottom of the openings in the top and bottom manifolds 244 and 246 in which the ends of storage tubes 240*a*, 240*b*, 240*c*, and 240*d* are located when the storage portion 238 is assembled in the manner hereinafter described. The space compensates for the elongation of the storage tubes 240*a*, 240*b*, 240*c*, and 240*d* that can occur when the storage tubes 240*a*, 240*b*, 240*c*, and 240*d* are crimped at each end to seal the fluid sample in the storage tubes 240*a*, 240*b*, 240*c*, and 240*d* in the manner hereinafter described. The bushings 248 are secured in the top and bottom manifolds 244 and 246 by holding plates 250 that are fixed to the manifolds by cap screws 252. An end cap 254 is threadably secured to the end of the tie rod 242 that extends beyond the lower end of the bottom manifold 246. Inlet and outlet valves 256*a* and 256*b* are threaded into holes 257 located in the upper end of the top manifold 244. As shown in FIG. 13, each of the holes 257 is in fluid communication with one of the top manifold openings 247 that receives one of the storage tubes 240*a* and 240*d*. As will be better understood from the following discussion, the inlet valve 256*a* is connected to an inlet storage tube 240*a* and the outlet valve 256*b* is connected to an outlet storage tube 240*d*. The other two storage tubes 240*b* and 240*c* form intermediate storage tubes.

Connectors 258*a* and 258*b* are located on the external ends of the valves 256*a* and 256*b*. One of the connectors 258*a* connects the inlet valve 256*a* to the inlet line 198 of the guide portion 186. The other connector 258*b* connects the outlet valve 256*b* to the cross-connector line 199 of the guide portion 186.

Figure 14A:
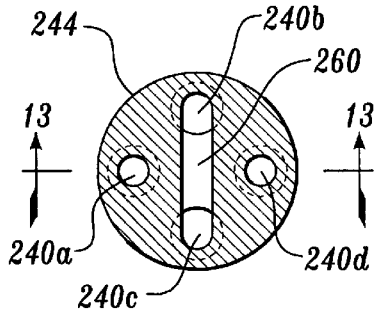
FIG. 14A is a cross-sectional view taken at lines 14A—14A of FIG. 13 showing the upper manifold of the sample container of FIG. 13.
Figure 14B:
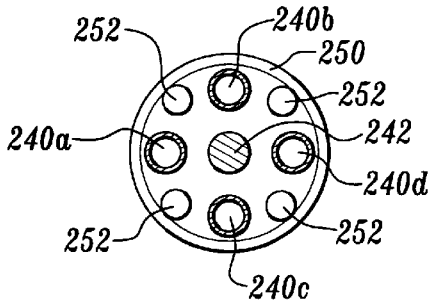
FIG. 14B is a cross-sectional view taken at lines 14B—14B of FIG. 13 showing the sample tubes of the sample container of FIG. 13.
Figure 14C:
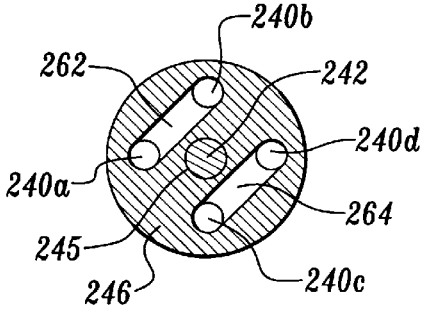
FIG. 14C is a cross-sectional view taken at line 14C—14C of FIG. 13 showing the lower manifold of the sample container of FIG. 13.

Referring to FIG. 14A, the top manifold 244 has a longitudinal channel 260 that is in fluid communication with the upper ends of the intermediate storage tubes 240*b* and 240*c*. Referring to FIG. 14C, bottom manifold 246 has two longitudinal channels 262 and 264. One of the longitudinal channels 262 is in fluid communication with the lower ends of the inlet storage tube 240*a* and one of the intermediate storage tubes 240*b*. The other longitudinal channel 264 is in fluid communication with the lower ends of the other intermediate storage tube 240*c* and the outlet storage tube 240*d*.

As will be appreciated from the foregoing description, fluid entering the storage portion 238 from the inlet line 198 of the guide portion 186 first passes through the inlet valve 256*a*. The upper manifold 244 directs the fluid into the top of the inlet storage tube 240*a*. Fluid exiting the bottom of the inlet tube 240*a* enters one of the longitudinal channels 262 located in bottom manifold 246. This longitudinal channel 262 directs the fluid to the bottom of storage tube 240*b*. Fluid exiting the top of this intermediate storage tube 240*b* enters the longitudinal channel 260 in the top manifold 244. This longitudinal channel 260 directs the fluid to the top of the other intermediate storage tube 240*c*. Fluid exiting the bottom of this intermediate storage tube 240*c* enters the other longitudinal channel 264 in the bottom manifold 246. Fluid exiting this longitudinal channel 264 enters the bottom of the outlet storage tube 240*d*. The fluid exiting the top of the outlet storage tube 240*d* is directed by the upper manifold 244 to the outlet valve 256*b*.

Fluid samples for non-in situ offsite analysis are collected by securing connector 258*a* to the outlet connection 191 coupled to the inlet line 198 of guide portion 186. The outlet connector 258*b* is secured to the inlet connector 193 coupled to the cross-connector line 199 of the guide portion 186. After insertion into a borehole and aligning the guide portion 186 with a measurement port coupler 26, the valve motor 216 is actuated to open the input and output line valves 212 and 214 of the guide portion 186. A fluid sample from a zone 32 passes through input line 198 of guide portion 186 and into the storage tubes 240*a*, 240*b*, 240*c*, and 240*d* in seriatim. If in situ analysis is to be performed, the fluid flows to the analyzing portion 188. Regardless of whether in situ analysis is or is not to be performed, after the storage tubes 240*a*, 240*b*, 240*c*, and 240*d* are full, the valve motor 216 is actuated to close the input and output line valves 212 and 214. After the in situ sample analyzing probe 124 is removed from the borehole, the storage tubes are crimped at each end. Then the storage portion 238 is disassembled and the storage tubes are removed and sent to a laboratory for analysis of their fluid content.

Figure 15:
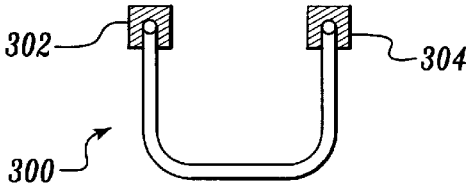
FIG. 15 is a pictorial view of a third embodiment of the sample container of the in situ sample analyzing probe of the present invention.

FIG. 15 illustrates a third storage portion 300, which comprises a simple U-tube sample bottle. The tube is preferably formed of copper. The ends of the tube 302, 304 can be crimped to seal the sample within the tube for later analysis.

Though the foregoing describes the application of the valve system of the invention to a coupler, it should be understood that those skilled in the art can easily apply the same valve system to any other tubular elements, such as an elongate casing and a packer element.

While the presently preferred embodiment of the invention has been illustrated and described, it will be appreciated that within the scope of the appended claims various changes can be made therein without departing from the spirit of the invention.

The embodiments of the invention in which an exclusive property or privilege is claimed are defined as follows:

1. An in situ underground sample analyzing apparatus for use in a multilevel borehole monitoring system, the apparatus comprising:

a tubular casing coaxially alignable in a borehole, said tubular casing having a first opening for collection of fluid therethrough from the underground external environment and a second opening for release of fluid therethrough into the underground external environment;

an in situ sample analyzing probe orientable in said tubular casing, said in situ sample analyzing probe having a first opening alignable with said first opening of said tubular casing for collection of fluid therethrough from the underground external environment and a second opening alignable with said second opening of said tubular casing for release of fluid therethrough into the underground external environment;

a fluid circulator for circulating fluid within said in situ sample analyzing probe collected through said first opening of said in situ sample analyzing probe and said first opening of said tubular casing for in situ analysis and for subsequent release of at least a portion of the fluid through said second opening of said in situ sample analyzing probe and said second opening of said tubular casing; and a fluid analyzer for analyzing fluid from the underground external environment, said fluid analyzer located in said in situ analyzing probe and in communication with said fluid circulator.

2. The apparatus of claim 1, further comprising a sample container for retaining in said in situ sample analyzing probe at least a portion of fluid collected through said first opening of said tubular casing and said first opening of said in situ sample analyzing probe for non-in situ analysis or for subsequent discharge into the underground external environment.

3. The apparatus of claim 2, wherein said fluid circulator releases additional fluid from the surface or from the fluid sample container into the underground external environment through said second opening of said in situ sample analyzing probe and said second opening of said tubular casing.

4. The apparatus of claim 1, wherein said fluid circulator releases additional fluid from the surface into the underground external environment through said second opening of said in situ sample analyzing probe and said second opening of said tubular casing.

5. The apparatus of claim 1, wherein said in situ sample analyzing probe includes:

a guide portion having a location member mateable with a track on the interior surface of said tubular casing; and an analyzing portion containing an in situ sample analyzing apparatus, said analyzing portion being removably connected to said guide portion.

6. The apparatus of claim 5, wherein said first opening and said second opening of said in situ sample analyzing probe are in said guide portion and are in fluid communication with said analyzing portion.

7. The apparatus of claim 5, wherein said guide portion includes an extendible shoe braceable against the interior surface of said tubular casing to move laterally said in situ sample analyzing probe within said tubular casing to press said first opening and said second opening of said in situ sample analyzing probe against said first opening and said second opening of said tubular casing.

8. The apparatus of claim 1, further comprising:

a first valve seated in said first opening of said tubular casing; and a second valve seated in said second opening of said tubular casing, each of said valves having a stem facing the interior of said tubular casing and being recessed in the corresponding opening so that said stem does not extend beyond the interior surface of said tubular casing into the interior of said tubular casing.

9. The apparatus of claim 8, wherein said first and second valves are opened when said in situ sample analyzing probe is pressed against the interior surface of said tubular casing.

10. The apparatus of claim 8, further comprising:

a first cover plate attached to the exterior surface of said tubular casing in a position over said first valve; and a second cover plate attached to the exterior surface of said tubular casing in a position over said second valve, wherein said cover plates include a plurality of holes therethrough to filter fluids.

11. The apparatus of claim 10, further comprising a tube having two ends, one of said ends being attached to one of said cover plates and the other end of said tube being positioned at a greater distance from the other cover plate than the distance between said cover plates.

12. A method of in situ underground sample analysis comprising:

orienting an in situ underground sample analyzing probe in a tubular casing aligned in a borehole, the tubular casing having a first opening for collection of fluid from the underground external environment and a second opening for release of fluid into the underground external environment;

aligning a first opening in the in situ underground sample analyzing probe with the first opening of the tubular casing for collection of fluid in the in situ underground sample analyzing probe;

aligning a second opening in the in situ underground sample analyzing probe with the second opening of the tubular casing for release of fluid from the in situ underground sample analyzing probe;

circulating fluid collected from the underground external environment within the in situ underground sample analyzing probe; and analyzing the circulated fluid within the in situ underground sample analyzing probe.

13. The method of claim 12 further comprising releasing at least a portion of the analyzed fluid through the second opening of the in situ underground sample analyzing probe, through the second opening of the tubular casing and into the underground external environment.

14. The method of claim 12 further comprising releasing additional fluid from the surface through the in situ underground sample analyzing probe and the tubular casing, and into the underground external environment.

15. The method of claim 12 further comprising retaining at least a portion of the fluid collected from the underground external environment within the in situ underground sample analyzing probe for subsequent non-in situ analysis or for subsequent discharge into the underground external environment.

* * * * *